US007222814B2

(12) United States Patent
Bohn et al.

(10) Patent No.: US 7,222,814 B2
(45) Date of Patent: May 29, 2007

(54) DEVIATING DEVICE FOR A BAND IN A REELING PLANT

(75) Inventors: Andreas Bohn, Hilchenbach (DE); Matthias Peters, Kreuztal (DE); Karl Hoen, Netphen (DE); Dominik Geibert, Kaden (DE)

(73) Assignee: SMS Demag AG, Dusseldorf (DE)

( * ) Notice: Subject to any disclaimer, the term of this patent is extended or adjusted under 35 U.S.C. 154(b) by 226 days.

(21) Appl. No.: 10/505,824

(22) PCT Filed: Jan. 30, 2003

(86) PCT No.: PCT/EP03/00930

§ 371 (c)(1),
(2), (4) Date: Aug. 26, 2004

(87) PCT Pub. No.: WO03/072277

PCT Pub. Date: Sep. 4, 2003

(65) Prior Publication Data

US 2005/0087579 A1 Apr. 28, 2005

(30) Foreign Application Priority Data

Feb. 28, 2002 (DE) ..... 102 08 964

(51) Int. Cl.
*B65H 18/08* (2006.01)

(52) U.S. Cl. ..... 242/531.1; 242/534; 242/615.1

(58) Field of Classification Search ..... 242/531.1, 242/566, 532.2, 615.1, 615.11, 615.4; 72/146, 72/148; 226/181, 188, 189
See application file for complete search history.

(56) References Cited

U.S. PATENT DOCUMENTS

| | | | | |
|---|---|---|---|---|
| 4,669,679 | A * | 6/1987 | Pali | 242/362.1 |
| 6,039,283 | A | 3/2000 | Munoz-Baca | |
| 6,082,659 | A * | 7/2000 | Sankaran et al. | 242/527.2 |
| 6,364,242 | B1 * | 4/2002 | Braun et al. | 242/532 |
| 6,578,789 | B1 * | 6/2003 | Braun et al. | 242/531.1 |

FOREIGN PATENT DOCUMENTS

| | | |
|---|---|---|
| EP | 0792703 | 9/1997 |
| JP | 3297750 | 12/1991 |
| JP | 0890064 | 9/1996 |
| JP | 0271640 | 3/2000 |
| WO | 0007747 | 2/2000 |

* cited by examiner

*Primary Examiner*—Emmanuel Marcelo
*Assistant Examiner*—Evan H Langdon
(74) *Attorney, Agent, or Firm*—Abelman, Frayne & Schwab

(57) ABSTRACT

A deflection for deflecting a strip in a reeling plant, in particular, of a metal strip from an initial channel to a final channel arranged above the initial channel and vice versa, wherein a drive acts with an upper drive roller on the upper side and with a lower drive roller on the lower side of the strip, can be improved when a temporarily pivotable into a strip, upper separating device is arranged downstream of the upper drive roller, and a temporarily pivotable into a strip, lower separating device is arranged downstream of the lower drive roller.

7 Claims, 8 Drawing Sheets

DEVIATING DEVICE FOR A BAND IN A REELING PLANT

The invention relates to a deflection device for deflecting a strip in a reeling plant, in particular, of a metal strip from an initial channel to a final channel arranged above the initial channel and vice versa, wherein a drive acts with an upper drive roller on the upper side and with a lower drive roller on the lower side of the strip. During a continuous winding of strips, in particular metal strips, the beginning, the so-called strip head, of a following strip is fed to another reel then the end of the preceding strip. The strip has to be guided from an initial channel into a final channel and vice versa. In practice, both multi-reel plants and rotor-or turret reels are used. They differ in that in the multi-reel plants during a further strip change, a change to the initial channel takes place, and with a rotor-or turret reel, a change again from the initial channel to the final channel should be made.

A deflection device and a deflection process for a metal strip is disclosed in WO 00/07747. The strip here is deflected from an initial channel to a final channel and vice versa by subjecting the strip to action of a medium. To this end, the upper side or the lower side of the metal strip is acted upon with nozzles with compressed air or by water under pressure, so that a deflection of the strip in a direction toward a respective channel takes place. This process is effected with the use of a distributing guide arranged between the channels.

Accordingly, the object of the invention is to improve a deflection device of the above-described type.

This object is achieved by associating the upper drive roller with an upper, temporarily pivotable into the strip, separating drive and by associating the lower drive roller with a lower, temporarily pivotable into the band, separating device. In accordance with a setting of the upper or lower separating device relative to a horizontal, exiting between the drive-rollers, strip, it is deflected in a direction of a respective feeding channel. When the upper separating device plunges from above into the strip, it is deflected toward the lower lying initial channel, whereas when the lower separating device plunges from below into the strip, it is deflected toward the above lying final channel.

According to an advantageous embodiment of the invention, each separating device consists of a drive table that is formed, at its end remote from a respective drive roller, with a free-running, alternatively driven guide roller. The guide table performs, on one hand, a task of guiding the strip, in particular the strip head from the drive roller to the respective guide roller associated with its free end, without it being interlocked or remain hanging.

On the other hand, the guide table serves simultaneously as a stripper for the drive roller, as the strip clings thereto when it is hot and is not tensioned, remaining clinged to the drive roller. According to the invention, the device table is provided at the front with a stripper. This one releases the hot, hanging on the drive roller, metal strip. The stripper can be formed as a separate, from the guide table, component arranged stationary on the drive roller. If in the separating construction, complementary to each other, in an operating position, engaging in each other ends of the stripper and the guide table are formed as cam-shaped ends, a clearance is avoided, i.e., a clearance-free transmission from the guide table to the stripper is achieved.

According to a further embodiment of the invention, for positioning the separating device, the guide table is pivotally supported at its end adjacent to the drive roller and can be pivoted about the support point by a corresponding, associated therewith drive, e.g., a hydraulic cylinder.

According to a further development of the invention, it is contemplated that the initial channel and the final channel are separated from each other by a stationary roller unit having at least one upper and one lower deflection roller. The roller unit is arranged at the mouth position of both channels, whereby the upper deflection roller is associated with the final channel, and the lower deflection roller is associated with the initial channel. Thus, the lower deflection roller and the free-running guide roller of the lower separating device and the upper deflection roller and the free-running guide roller of the upper separating device cooperate with each other. If the strip should be deflected from the initial channel in the final channel, the lower separating device, together with its guide roller, is pivoted upwardly. The strip is deflected about the guide roller and the lower deflection roller of the stationary roller unit and is guided into the initial channel. The immediately following strip head of the following strip is deflected likewise by the lower separating device and its guide roller in the final channel.

When analogously, the strip should be deflected from the final channel in the initial channel, the guide roller of the upper separating device and the upper deflection roller of the roller unit cooperate with each other. The upper separating device, together with its guide roller, is pivoted downwardly, so that the strip is deflected by the guide roller and the upper deflection roller in the final channel, whereas the immediately following strip beginning is deflected in the initial channel.

With this cooperation, which is providing by the roller unit, it is achieved that an immediately following each other strips are reliably deflected from one channel in another channel.

Further features and advantages follow from the claims and a description of an embodiment of the invention shown in the drawings.

Figure 1:
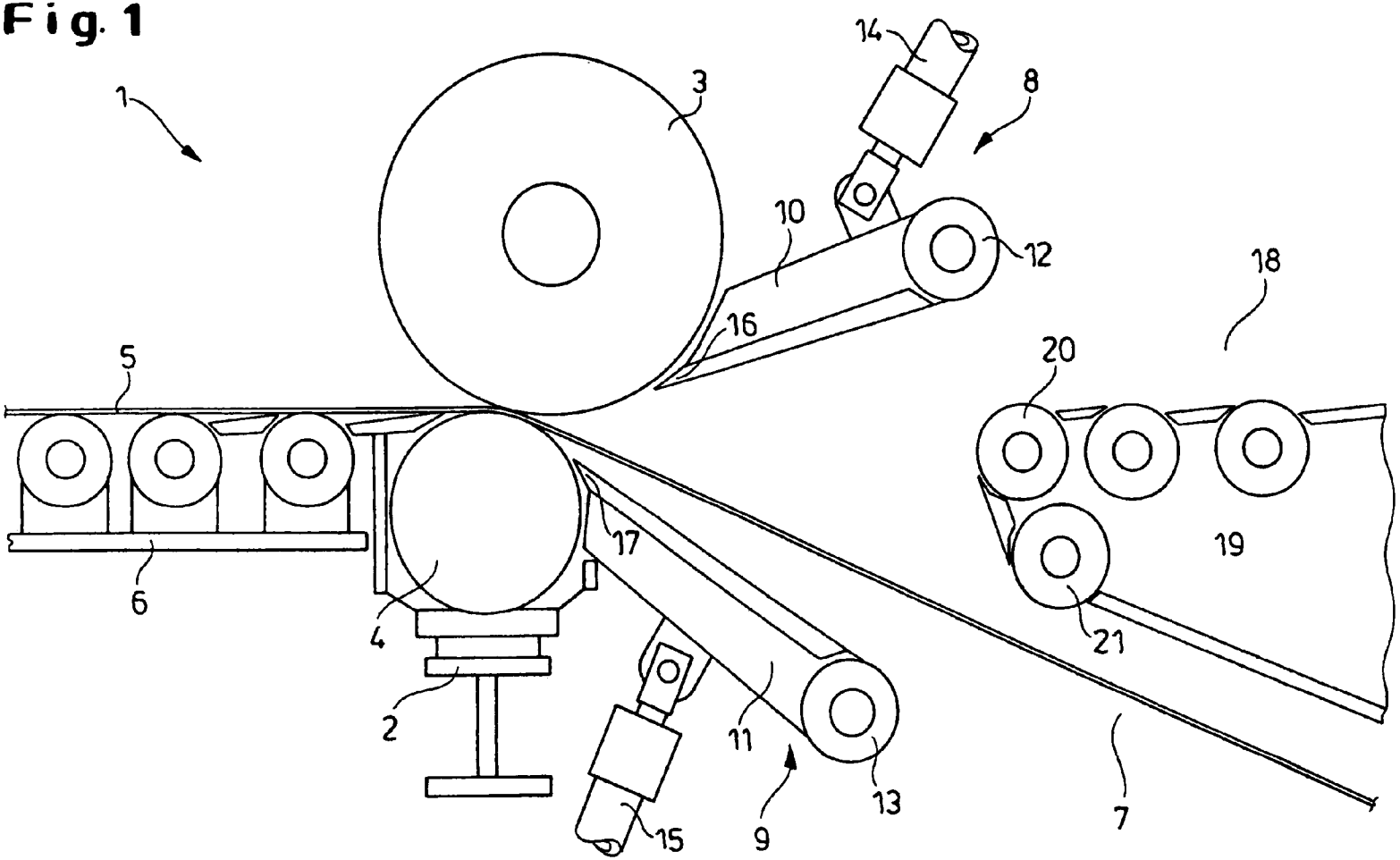
FIG. 1 shows a deflection device for a strip in a first operational condition.

According to FIG. 1, the deflection device 1 includes a reeling plant, which is not shown further, and a drive 2 having an upper drive roller 3 and a lower drive roller 4. The drive roller 3 acts on the upper side and the drive roller 4 acts on a bottom side of a metal strip 5. The drive rollers 3, 4 advance the metal strip 5 over a run-in side roller table 6 into an initial channel 7.

An upper separating device 8 is arranged downstream of the upper drive roller 3, and a lower separating device 9 is arranged downstream of the inner drive roller 4. Both devices 8 and 9 consist, respectively, of a guide table 10, 11 and a guide roller 12, 13 which is arranged at a free end thereof. Further, the drive tables 10, 11 are pivotably supported at their ends adjacent to the rollers 12, 13 and are pivoted by respective hydraulic cylinders 14, 15 about a support point, not shown, into the metal strip 5. Because the metal strip 5 is hot, there exists a danger that it would cling to one of the drive rollers 3, 4 when it is not tensioned. To prevent clinging, both the upper guide table 10 and the lower guide table 11 are provided with a stripper 16, 17 at their respective ends adjacent to the drive rollers 3, 4. The strippers 16, 17 strip the metal strip from the respective drive rollers 3, 4 in case it remains clinged thereto.

Figure 7:
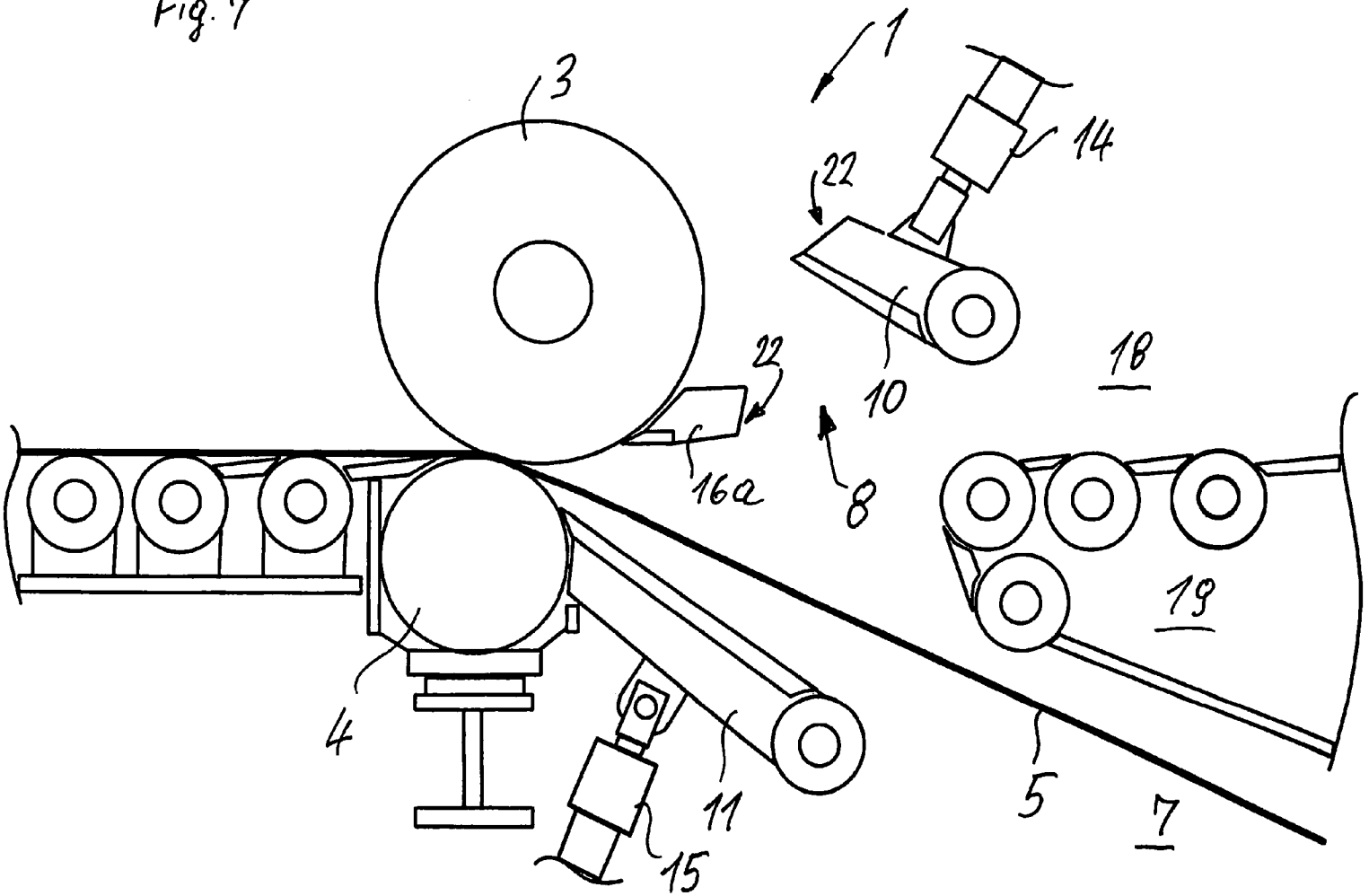
FIG. 7 shows another embodiment of the deflection device with a stripper separated from the guide table and arranged stationary on a drive roller, in this embodiment for simplicity sake, only for the upper separating device.
Figure 8:
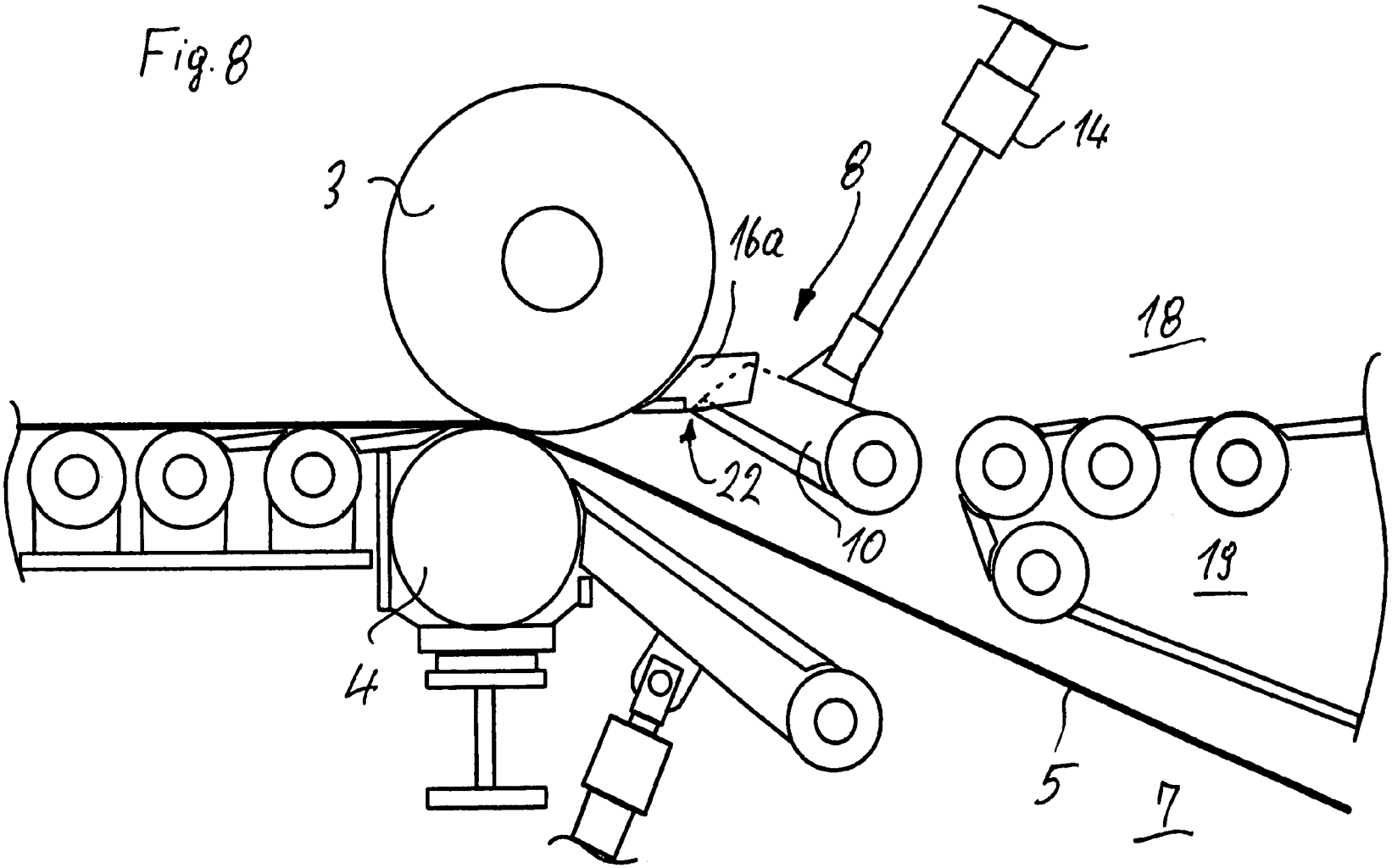
FIG. 8 shows a guide table runnable in or pivotable in the stripper.

On the example of the upper separating device 8, which otherwise remains non-changed relative to the previously described embodiment of the deflection device 1, there is shown in FIGS. 7–8 an embodiment in which the stripper 16*a* is arranged stationary on the drive roller 3 and, thus, is separated from the guide table 10 with its guide roller 12. During operation (see FIG. 8), the guide table 10 and its guide roller 12 are pivoted by the hydraulic cylinder 14 by a desired angle from above. The end of the stripper 16*a* remote from the drive roller is formed as a cam 22 as an end of the guide table 10 adjacent thereto. In the operational position according to FIG. 8, because of the cammed engagement, a clearance between the stripper 16*a* and the guide table 10 is avoided.

Downstream of separating devices 8, 9 and spaced therefrom, there is provided a stationary roller unit 19 arranged between the initial channel 7 and a final guide channel 18 located above the initial channel 7, and separating both channels 7 and 18 from each other, and including an upper deflection roller 20 associated with the final channel 18 and a lower deflection roller 21 associated with the initial channel 7.

With reference to FIGS. 2–6, a deflection process of a metal strip from the initial channel 7 into the final channel 18, on one hand, and from that into the initial channel 7, on the other hand, will now be described.

Figure 2:
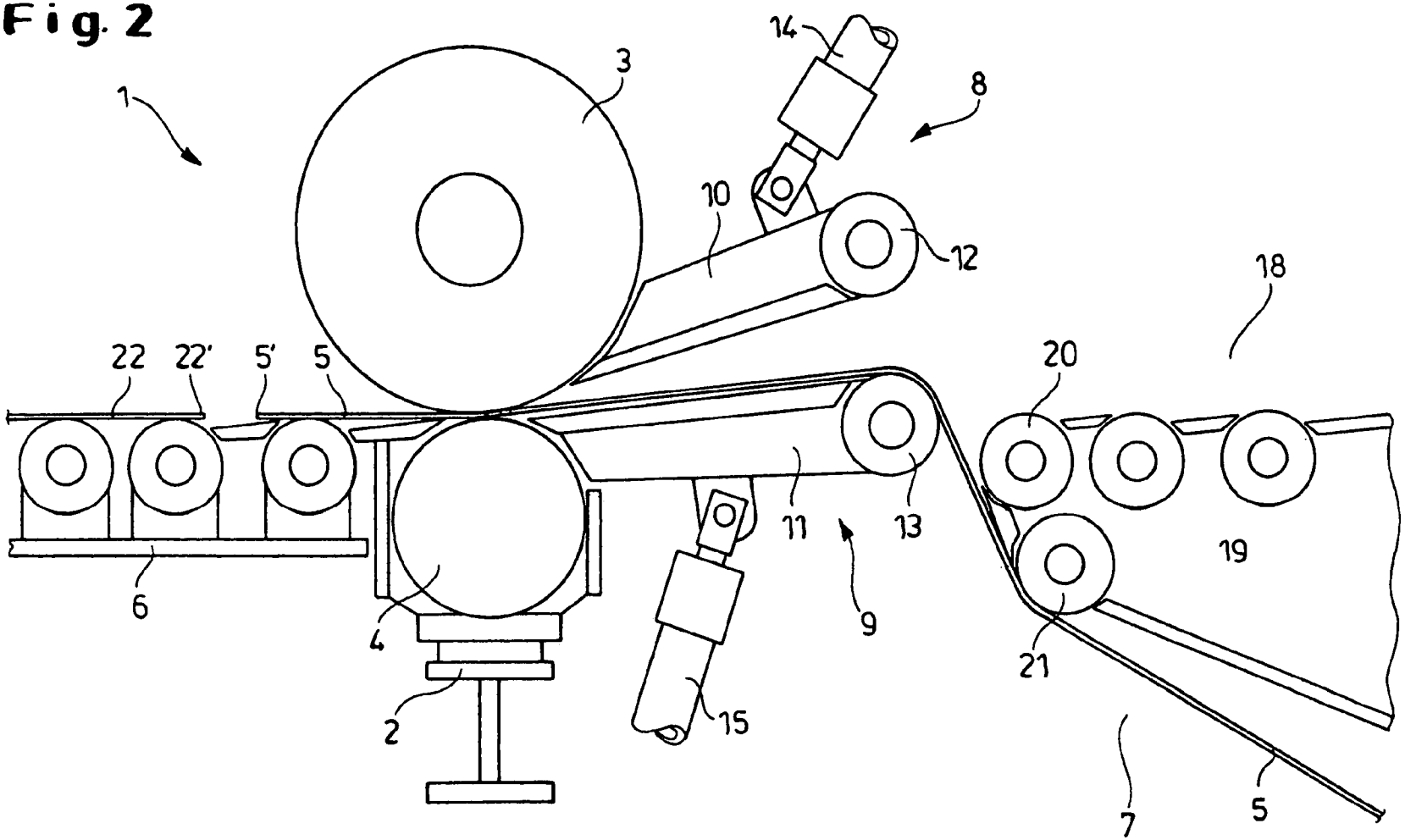
FIG. 2 shows a deflection device for a strip in a second operational condition.
Figure 3:
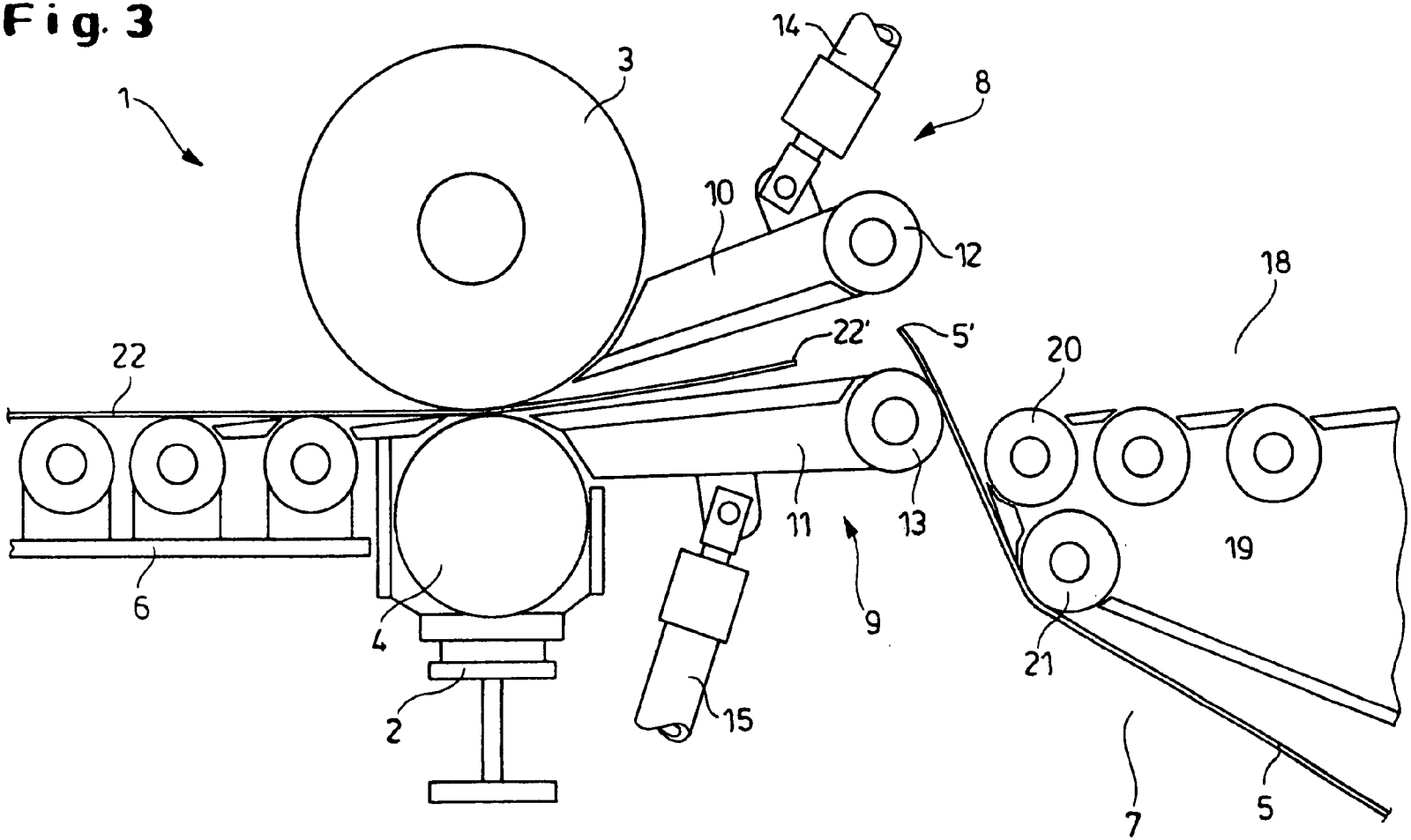
FIG. 3 shows a deflection device for a strip in a third operational condition.

FIG. 2 shows the metal strip 5 with its strip end 5' shortly before the drive rollers 3, 4. Immediately behind the strip end 5', a strip beginning 22' of a following metal strip 22 already runs over-the roller table 6. This following metal strip 22 or its beginning 22' should be deflected into the final channel 18. To this end, the lower separating device 9 is pivoted in its upper position (see FIG. 2) by the hydraulic cylinder 15. With this, the guide table 11 with its guide roller 13 lifts the strip 5 before the band end 5' passed the separating devices 8 and 9. The metal strip runs about the guide roller 13 and the lower roller 21 of the roller unit 19, so that the strip end 5' slides into the initial channel 7. The strip beginning 22' of the immediately following metal strip 22 slides over the guide table 11 and its guide roller 13 into the final channel 18 (see FIG. 3) which a reel for this strip adjoins.

Figure 4:
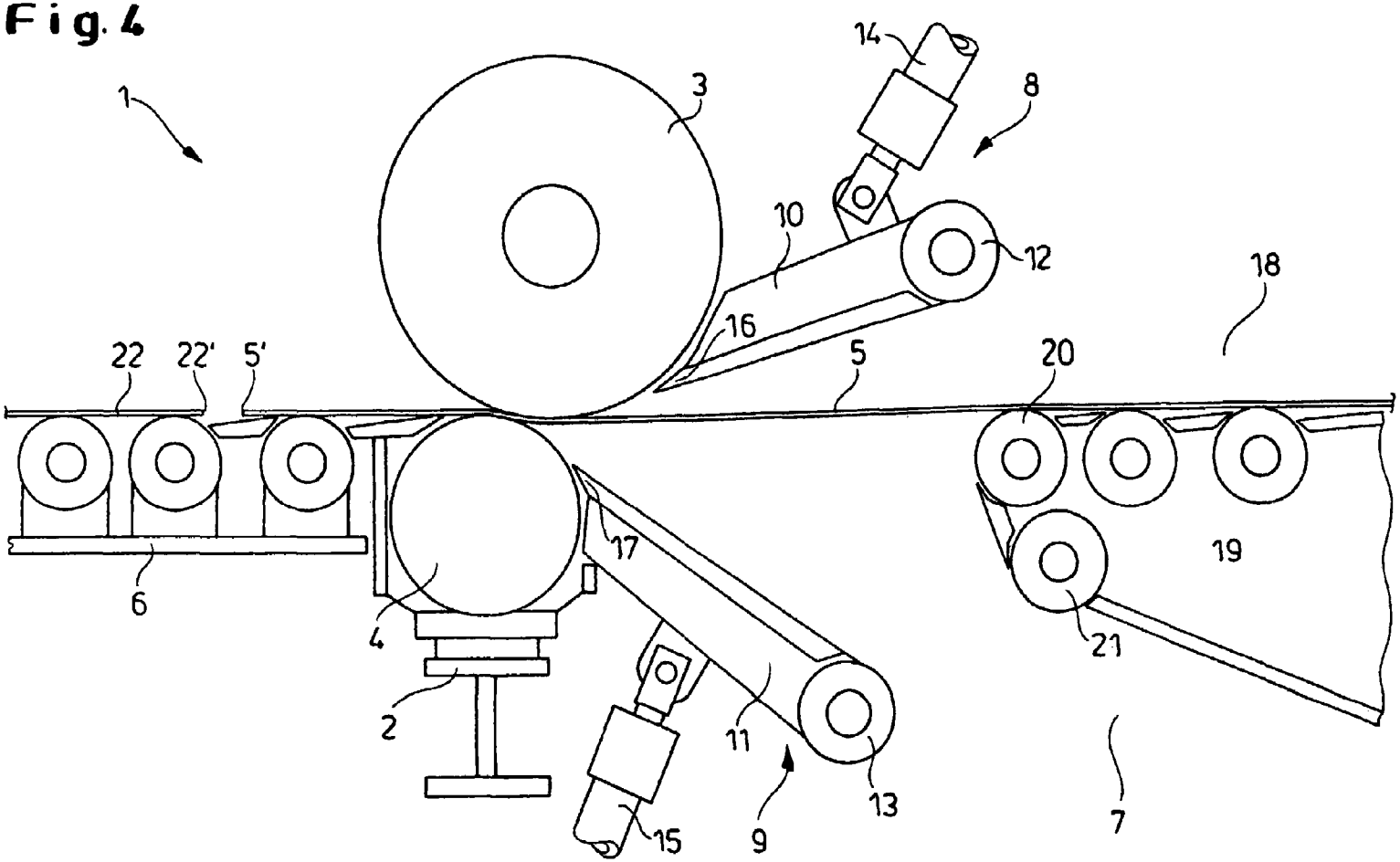
FIG. 4 shows a deflection device for a strip in a fourth operational condition.
Figure 5:
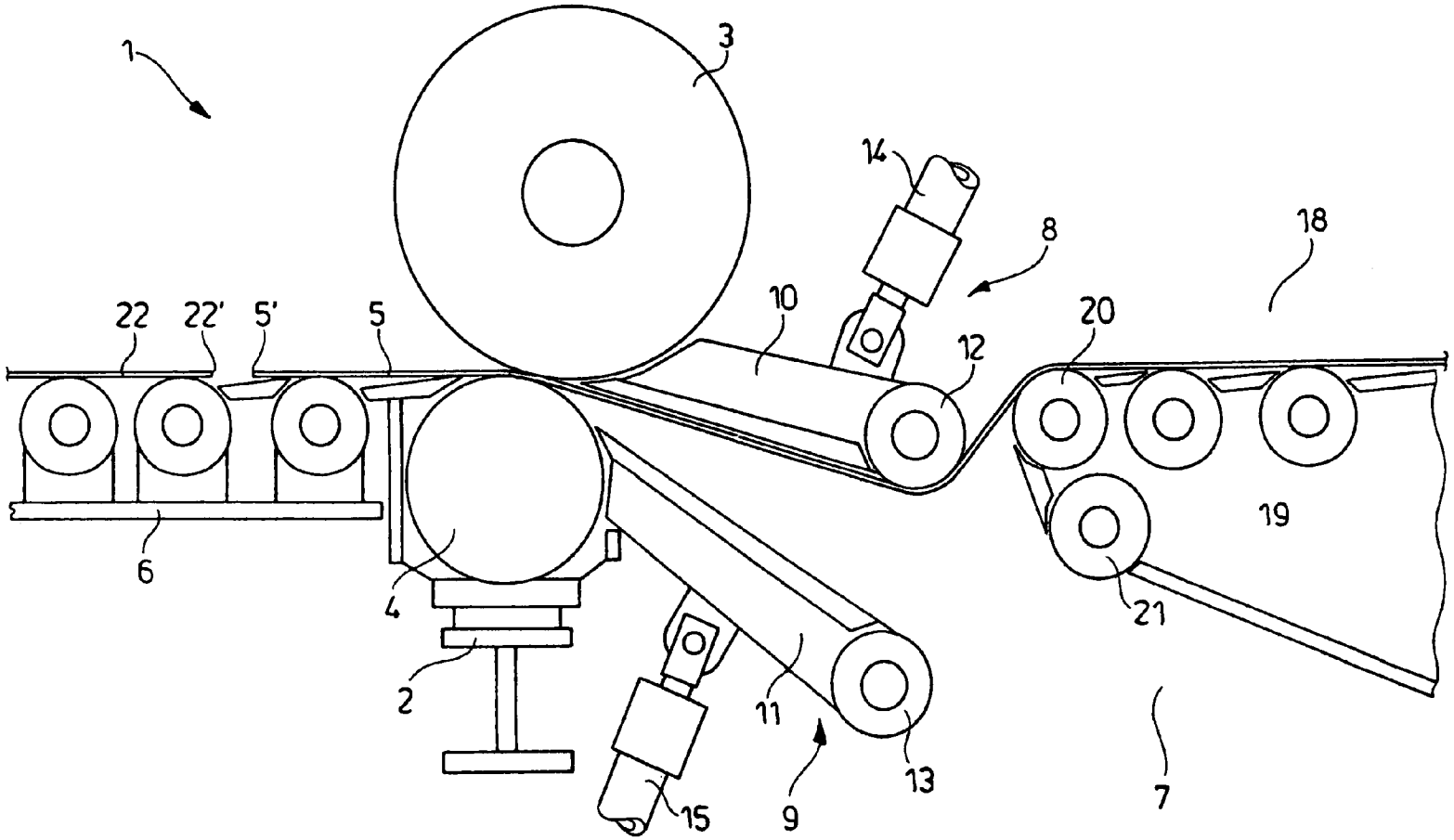
FIG. 5 shows a deflection device for a strip in a fifth operational condition.
Figure 6:
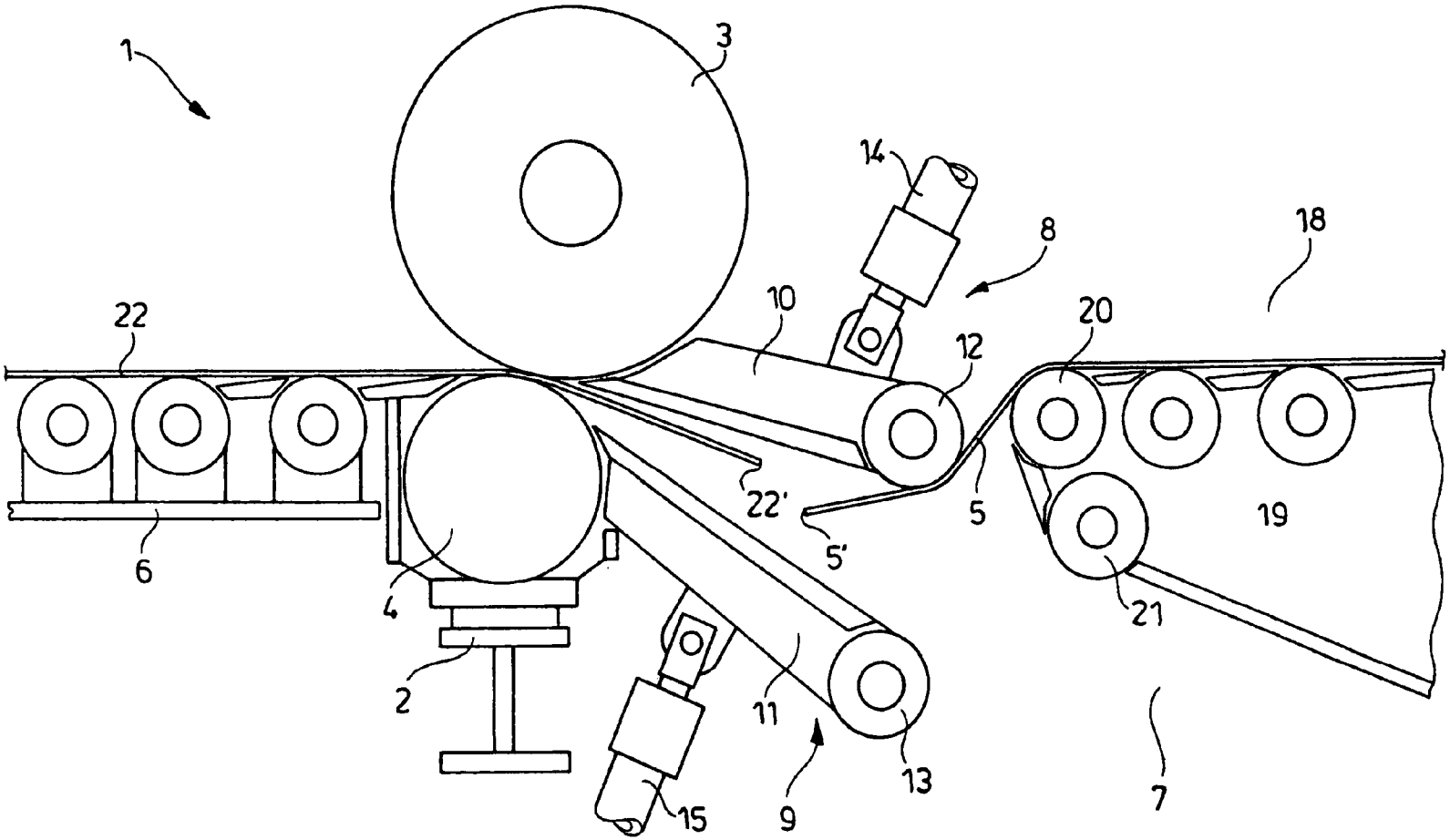
FIG. 6 shows a deflection device for a strip in a sixth operational condition.

In case the strip beginning 22' of the metal strip 22, which immediately follows the metal strip 5, should also be deflected into the initial channel 7 from the position in FIG. 4, the separating device 8 is pivoted by the hydraulic cylinder 14 in its lower position (see FIG. 5). With this, its guide table 10 with its guide roller 12 presses the metal strip 5 or its strip end 5' downwardly, whereby the metal strip 5 runs over the guide roller 12 and the deflection roller 20 of the roller unit 19 into the upper final channel 18, whereas the immediately following strip beginning 22' of the metal strip 22 is deflected by the guide table 10 and its guide roller 12 into the initial channel 7 (as shown in FIG. 6).

The possible alternating cooperation of either one or the other of separating devices 8 and 9 with the upper or lower deflection roller 20 or 21 of the roller unit 19 provides for a continuous feeding to the reel by feeding the metal strip in the final or initial channel 18 or 7.

The invention claimed is:

1. A deflection device for deflecting a metal strip in a reeling plant from an initial channel to a final channel arranged above the initial channel and from the final channel to the initial channel, wherein a drive acts with an upper drive roller on the upper side and with a lower drive roller on the lower side of the strip, characterized in that the upper drive roller (3) is associated with an upper separating device (8) pivotable into the strip (5) for deflecting the strip from the final channel to the initial channel, and the lower drive roller (4) is associated with a lower separating device (9) pivotable into the strip (5) for deflecting the strip from the initial channel to the final channel, and in that each separating device (8, 9) is formed of a guide table (10, 11) having, at its end remote from a respective drive roller (3, 4), a guide roller (12, 13).

2. A deflection device according to claim 1, characterized in that the guide tables (10, 11) are pivotable about that ends adjacent to the respective drive rollers (3, 4).

3. A deflection device according to claim 2, characterized in that the guide tables (10, 11) are provided at the front with a stripper (16, 17).

4. A deflection device according to claim 3, characterized in that a stripper (16*a*) separated from the guide table (10, 11), is stationary secured on the drive roller (3, 4).

5. A deflection device according to claim 4, characterized in that in an operating position, ends of a guide table (10, 11) and the stripper (16*a*) are formed as cam-shaped ends.

6. A deflection device according to claim 1, characterized in that an adjusting drive (14, 15) is associated with the guide table (10, 11).

7. A deflection device according to claim 1, characterized in that the initial channel (7) and the final channel (18) are separated from each other by a stationary roller unit (19) including at least one upper and at least one lower deflection roller (20, 21).

* * * * *